US006530751B1

(12) United States Patent
Song et al.

(10) Patent No.: US 6,530,751 B1
(45) Date of Patent: Mar. 11, 2003

(54) DEVICE FOR CONTROLLING AIR FILLING AND EXHAUSTING OF AN AIR CUSHION

(75) Inventors: Rong-Jyh Song, Taipei (TW); Tsung-Ping Yen, Taipei Hsien (TW)

(73) Assignee: Supertrend International Inc., Taipei (TW)

( * ) Notice: Subject to any disclaimer, the term of this patent is extended or adjusted under 35 U.S.C. 154(b) by 0 days.

(21) Appl. No.: 09/934,478

(22) Filed: Aug. 23, 2001

(51) Int. Cl.[7] ..... F04B 49/03

(52) U.S. Cl. ..... 417/26; 417/423.1; 137/522; 5/713

(58) Field of Search ..... 417/26, 423.1; 5/713; 137/522

(56) References Cited

U.S. PATENT DOCUMENTS 5,903,941 A * 5/1999 Shafer et al. ..... 318/601
5,904,172 A * 5/1999 Gifft et al. ..... 137/224
5,963,997 A * 10/1999 Hagopian ..... 5/654
6,009,580 A * 1/2000 Caminade et al. ..... 5/713
6,230,501 B1 * 5/2001 Bailey et al. ..... 62/51.1

* cited by examiner

*Primary Examiner*—Charles G. Freay
*Assistant Examiner*—Emmanuel Sayoc
(74) *Attorney, Agent, or Firm*—Bacon & Thomas

(57) ABSTRACT

A device for controlling air filling and air exhausting of an air cushion includes a casing provided inside with a motor controlled by a wire controller and a fan blade, and an upper cover mounted on the casing. An air-exhausting nozzle closed by a film is provided outside the casing. A support plate is positioned above the fan blade, fixed on an upper surface with a transformer and an electro-magnetic valve controlled by the wire controller. A push plate is combined on a front end of the magnetic rod of the electro-magnetic valve, having a push rod protruding through the casing and extending in the air-exhausting nozzle to push open the film. Then this device can be controlled by wire controlling or manual controlling to adjust resilience of an air cushion.

2 Claims, 5 Drawing Sheets

DEVICE FOR CONTROLLING AIR FILLING AND EXHAUSTING OF AN AIR CUSHION

BACKGROUND OF THE INVENTION

This invention relates to a device for controlling air filling and exhausting of an air cushion, particularly to one possible to be used selectively either by wire controlling or manual controlling, convenient in handling and easy to adjust the air pressure inside an air cushion any time.

Conventionally, an air-filling machine is used for filling air into an air cushion. The air-filling machine has an air-exhausting nozzle formed integral and a simple motor as well as a fan blade fitted inside, and the fan blade is driven by the motor to rotate to fill up the air cushion with air, but it has only one function of filling in air. In case a user lies on an air cushion too hard and wants to release some air from it, the user has to rise up to disassemble the air-filling machine from the air cushion so as to let the air get out of the air cushion, thus inconvenient in handling and difficult to control a proper resilience of an air cushion.

SUMMARY OF THE INVENTION

The objective of this invention is to offer a device for controlling air filling and exhausting of an air cushion, convenient in handling and controlling and possible to adjust the air pressure inside an air cushion any time.

The feature of this invention includes a casing provided inside with a motor controlled by a wire controller and a fan blade driven by the motor, and an upper cover fixed on the casing. The casing is bored on a front wall surface with a through hole connected with an air-exhausting nozzle in a front for the air inside an air cushion to flow out. The air-exhausting nozzle is shaped as a hollow column, having a nut threadably fitted around its outer circumference and a triggering member shaped as a hollow frame tucked inside. Then, a spring is fitted around a center rod of the triggering member, with one end resting on the annular projection formed around the inner wall of the air-exhausting nozzle in order to push the triggering member to be always positioned within the air-exhausting nozzle. The triggering member further has a film fixed on a front side for closing up the air-exhausting nozzle. In addition, a support plate is provided above the fan blade, fixed on a top surface with a transformer and an electro-magnetic valve controlled by the wire controller, and the electro-magnetic valve has a magnetic rod provided with a push plate fixed on one end facing the air-exhausting nozzle. Then, the push plate has a push rod fixed on one end to protrude through the casing and extend into the air-exhausting nozzle for pushing open the film and further has a pin protruding downward to be pivotally connected with one end of an interactive rod. The interactive rod has a through hole in the center for receiving a support stud on the support plate and has the other end protruding out of the casing and fixed with a sliding block, thus finishing assembling the device of this invention.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
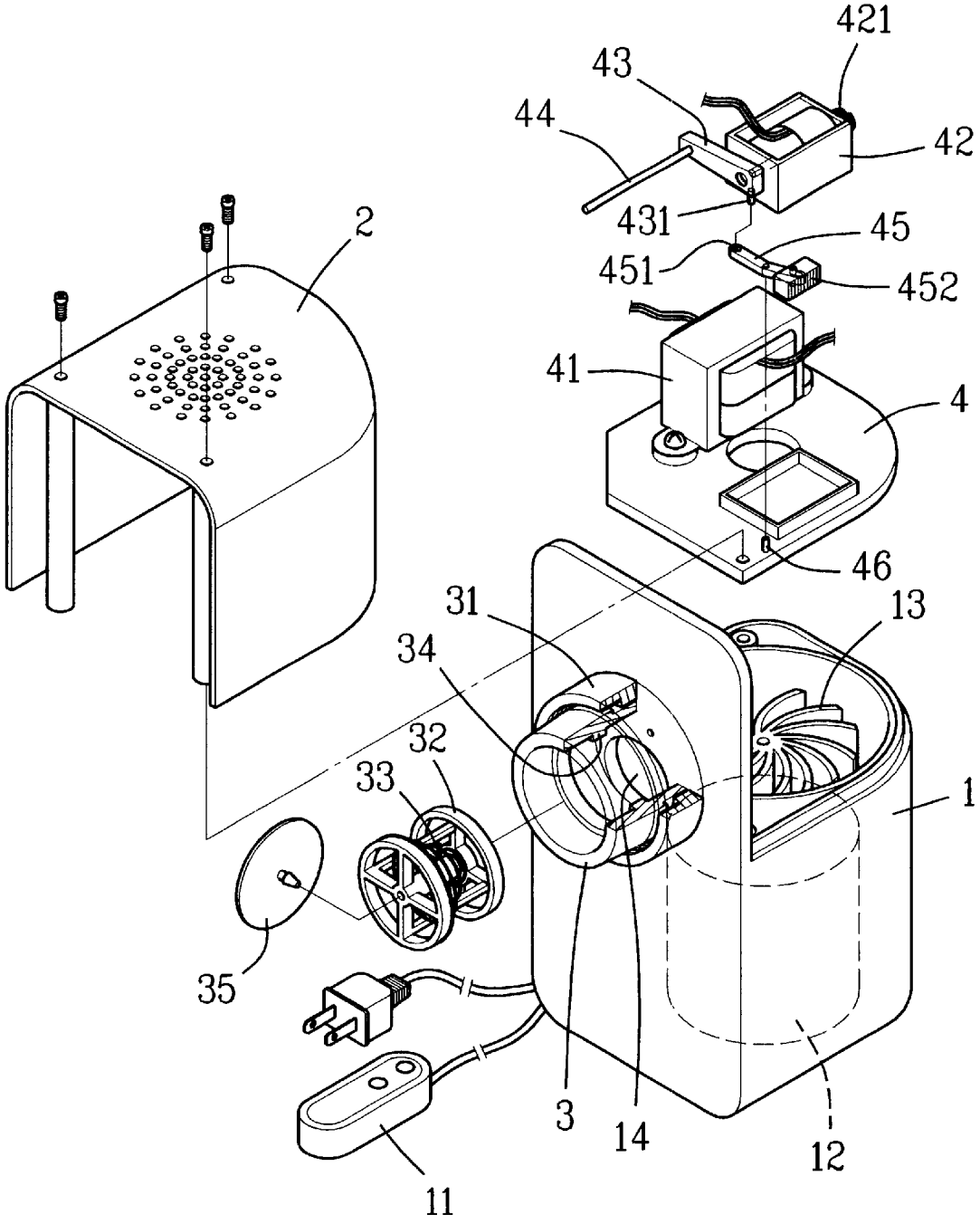
FIG. 1 is an exploded perspective view of a device for controlling air filling and exhausting of an air cushion in the present invention.

A preferred embodiment of a device for controlling air filling and exhausting of an air cushion in the present invention, as shown in FIG. 1, includes a casing 1, an upper cover 2, an air-exhausting nozzle 3 and a support plate 4 as main components combined together.

Figure 2:
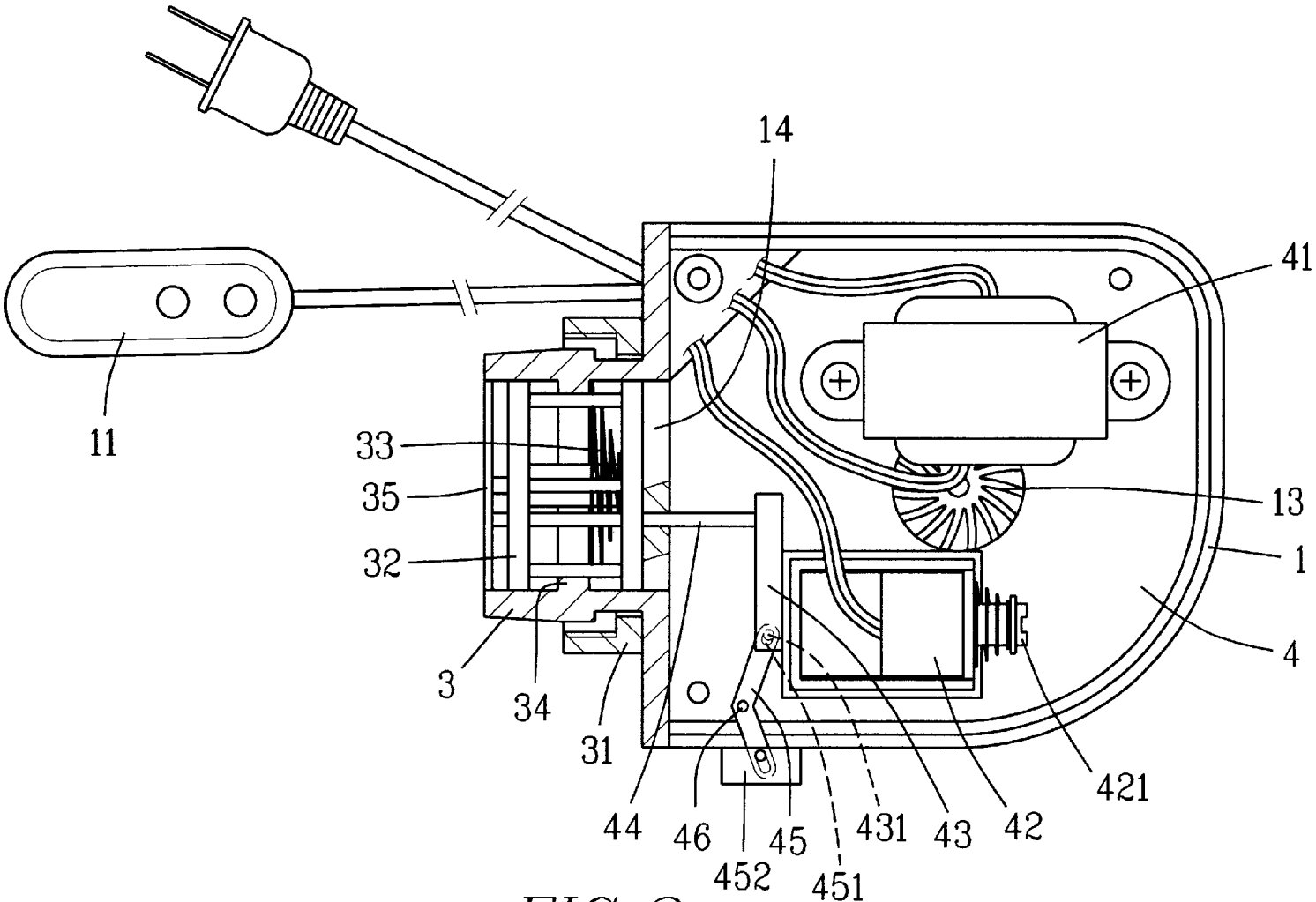
FIG. 2 is a cross-sectional view of the device for controlling air filling and exhausting of an air cushion in the present invention.

The casing 1 is provided inside with a motor 12 controlled by a wire controller 11 and a fan blade 13 driven by the motor 12, having a through hole 14 bored in a front wall to connect with an air-exhausting nozzle 3 on an outer side for the air inside an air cushion to flow out. The air-exhausting nozzle 3 is shaped as a hollow column, having a nut 31 threadably fitted around its outer circumference and an annular triggering member 32 tucked inside. The triggering member 32 is shaped as a hollow frame, having a spring 33 fitted around its center rod, with the front end of the spring 33 resting on an annular projection 34 formed on the inner wall of the air-exhausting nozzle 3 in order to force the triggering member 32 to be always positioned within the air-exhausting nozzle 3, as shown in FIG. 2. Then a film 35 is fixed on the front side of the triggering member 32 for closing up the air-exhausting nozzle 3.

The support plate 4 is fixed on the casing 1 and above the fan blade 13 of the casing 1 and fixed on a top side with a transformer 41 and an electro-magnetic valve 42 controlled by the wire controller 11. The electro-magnetic valve 42 has a magnetic rod 421 and a push plate 43 fixed on one end of the magnetic rod 421 facing the air-exhausting nozzle 3. Further, the push plate 43 has a push rod 44 fixed on one end to protrude through the wall of the casing 1 and extend in the air-exhausting nozzle 3, and a pin 431 positioned at the bottom and protruding downward to be pivotally fitted with one end of a <-shaped interactive rod 45. The interactive rod 45 has a through hole 451 on center for receiving a support stud 46 on the support plate 4 and has its other end protruding out of the casing 1 and pivotally connected with a sliding bloc 452. Additionally, the upper cover 2 is a hollow bottom and mounted on the support plate 4.

In assembling, as shown in FIG. 2, firstly, place the spring 33 against the annular projection 34 to permit the triggering member 32 pull inward the film 35 closing up the air-exhausting nozzle 3. Next, fix the support plate 4 on the casing 1 above the fan blade 13 and let the push rod 44 on an outer side of the electro-magnetic valve 42 protrude through the casing 1 and extend in the air-exhausting nozzle 3, and then the interactive rod 45 has its one end with the sliding block 452 protrude out of the casing 1. Lastly, the upper cover 2 is mounted on the support plate 4. Thus, the device for filling air in and exhausting air from an air cushion is completed.

Figure 3:
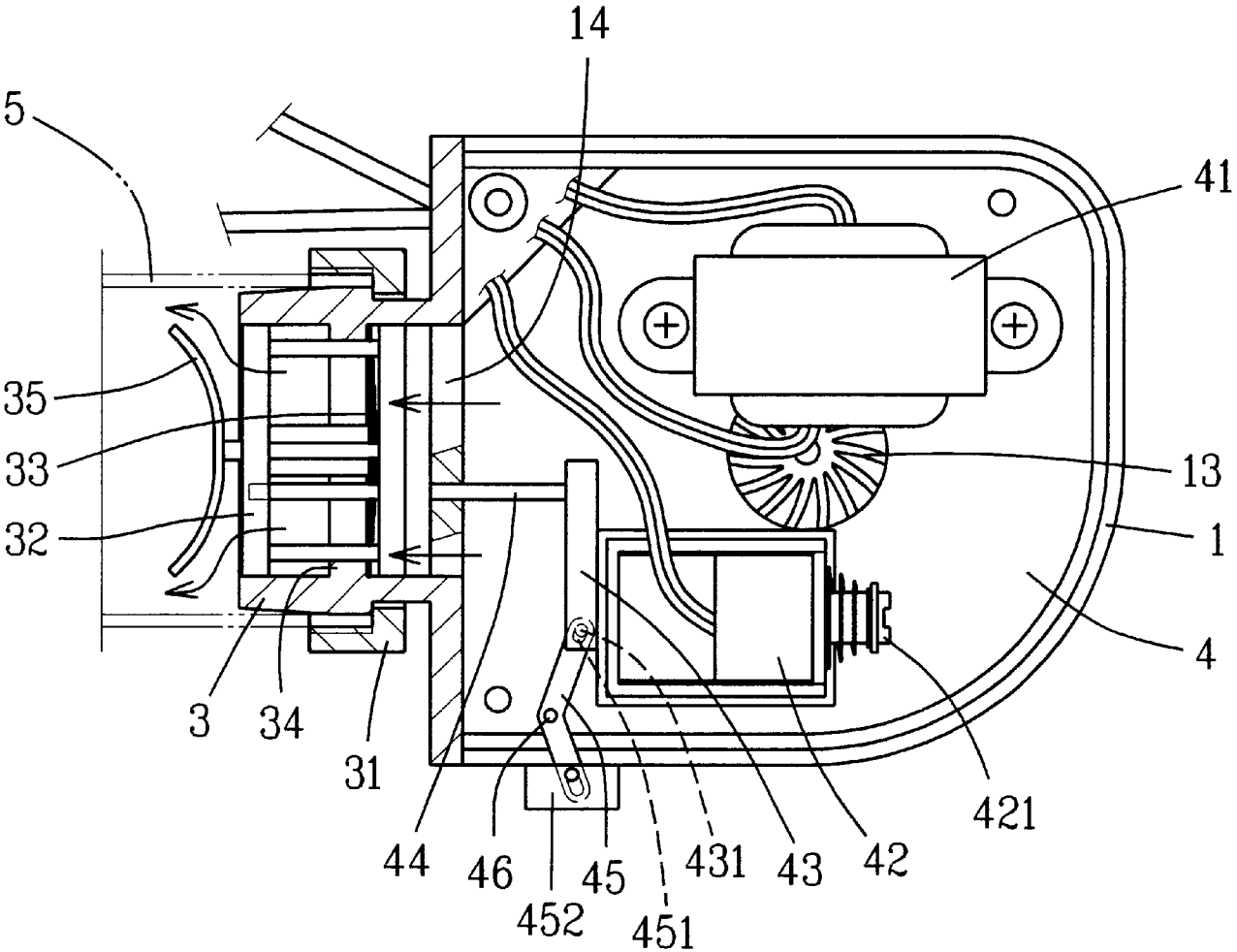
FIG. 3 is a cross-sectional view of the device in an air-filling condition in the present invention.
Figure 4:
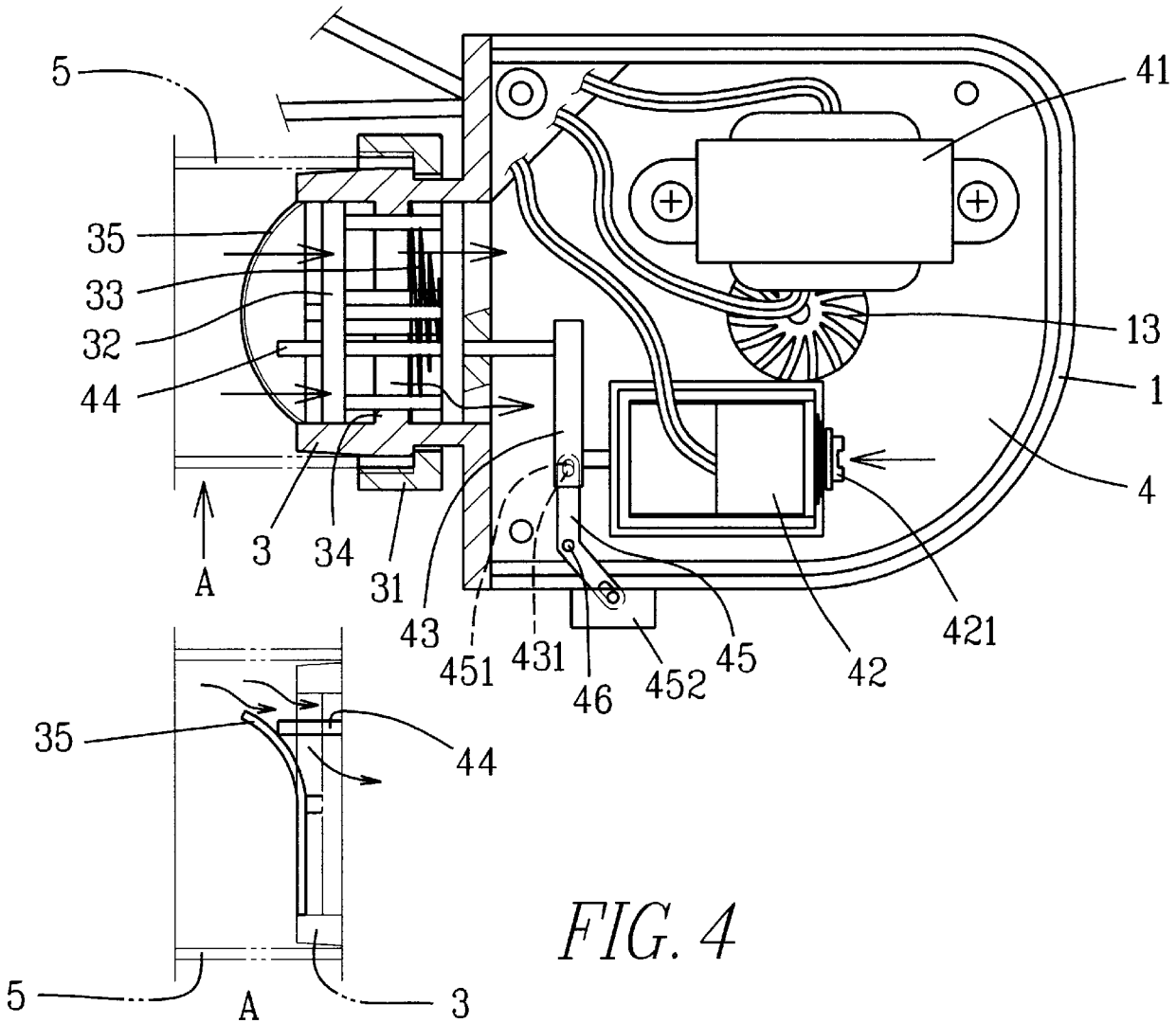
FIG. 4 is a cross-sectional view of the device in a first stage of an air-exhausting condition in the present invention.

In using, the air-exhausting nozzle 3 is first tucked in the air-intake nozzle 5 of an air cushion (not shown) and then the nut is threadably fitted around the air-intake nozzle 5, letting the device of this invention positioned on the outer side of the air cushion, as shown in FIG. 3. Next, the motor 12 is started by the wire controller 11 to activate the fan blade 13 to rotate, and synchronously the wind produced blows to the air-exhausting nozzle 3 via the through hole 14 and automatically pushes open the triggering member 32 and the film 35 to get in and inflate the air cushion. When the air cushion is inflated to a proper resilience, the motor 12 as well as the fan blade 13 is stopped, and in the meanwhile the triggering member 32 and the film 35 recover to close up the air-exhausting nozzle 3 because of no wind pushing them any more, with the spring 33 recovering its position and a reverse pushing force from inside the air cushion recovering closing the nozzle 3, as shown in FIG. 2. Thus, the air inside the air cushion is kept not leaking out at all.

In addition, in case the air cushion is too hard and needs to exhaust a great quantity of air out, the wire controller 11 is handled to activate the electro-magnetic valve 42 to operate to let its magnetic rod 421 push the push plate 43 to move toward one side of the air-exhausting nozzle 3, and at the same time the push rod 44 of the push plate 43 is actuated to move close to the film 35 and then push it open with its front end. Thus, the air in the air cushion exhausts through the gap between the film 35 and the air-exhausting nozzle 3 to soften the air cushion. Therefore, according to liking, a user can decide when to stop exhausting the air from the air cushion by controlling the wire controller 11 to let the electric-magnetic valve 42 cut off electricity, and the push plate 43, the push rod 44 and the film 35 all recover their original positions, as shown in FIG. 2.

Figure 5:
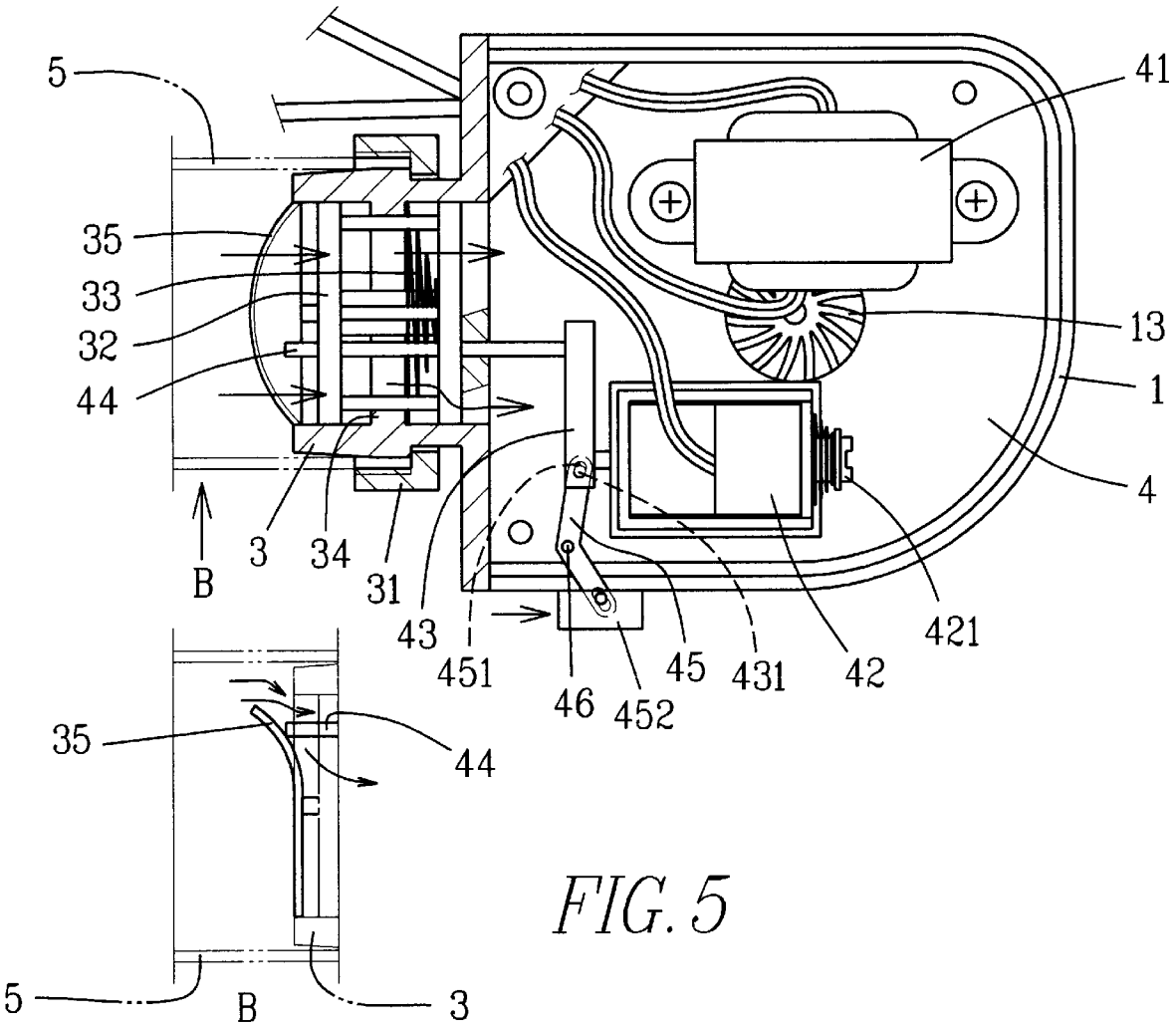
FIG. 5 is a cross-sectional view of the device in a second stage of an air-exhausting condition in the present invention.

On the other hand, if only a little air needs to be exhausted from the air cushion to obtain a comfortable condition, manual controlling can be used, referring to FIG. 5, by manually pushing the sliding block 452 positioned on the outer side of the casing 1 to move and activate the interactive rod 45 to turn eccentrically, with the support stud 46 serving as a fulcrum. Thus, the interactive rod 45 will activate the push plate 43 and the push rod 44 to move toward the film 35, and then the front end of the push rod 44 will directly push open the film 35 to let the air inside the air cushion flow out gradually through the gap between the film 35 and the air-exhausting nozzle 3 so as to soften the air cushion slowly. Additionally, exhausting of the air in an air cushion can be carried on step by step by releasing the sliding block 452 any time one likes to let the film 35 close up the air-exhausting nozzle 3 again to recover the condition shown in FIG. 2. In short, the air cushion can be adjusted to a comparatively comfortable condition by using the wire controller 11 to start the motor 12 for filling in air or start the electro-magnetic valve 42 for exhausting air or move the sliding block 452 by hand for exhausting air, apparently having good mobility to satisfy a user's need.

Evidently, this invention has the following advantages as can be understood from the above description.

1. It can be used for both filling air in and exhausting air from an air cushion, solving the problem of only filling in air and not exhausting air of a conventional device.

2. Both wire controlling and manual controlling are available for filling air in or exhausting air from an air cushion depending on one's need and preference, thus convenient in handling and easy in controlling the resilience of an air cushion.

While the preferred embodiment of the invention has been described above, it will be recognized and understood that various modifications may be made therein and the appended claims are intended to cover all such modifications that may fall within the spirit and scope of the invention.

We claim:

1. A device for controlling air filling and exhausting of an air cushion comprising a casing, an upper cover, an air-exhausting nozzle and a support plate:

said casing provided inside with a motor controlled by a wire controller and a fan blade driven by said motor, said casing bored in one wall with a through hole connected with said air-exhausting nozzle in a front side, said air-exhausting nozzle shaped as a hollow column and having a nut threadably fitted around and a hollow frame-shaped triggering member positioned inside, said triggering member having a spring fitted around a center rod, with one end of said spring resting on an annular projection formed around an inner wall of said air-exhausting nozzle to push against said triggering member to be always positioned within said air-exhausting nozzle, said triggering member having a film provided at a front side for closing up said air-exhausting nozzle, a support plate fixed on an end of said casing, a transformer and an electro-magnetic valve fixed on an upper side of said support plate, said electro-magnetic valve having a magnetic rod fixed with a push plate on one end facing said air-exhausting nozzle, said push plate provided at one end with a push rod protruding through said casing and extending into said air-exhausting nozzle, said push plate further fixed on a bottom edge with a pin protruding downward, said pin pivotally fitted on one end of an interactive rod, said interactive rod having a through hole in a center to receive a support stud on said support plate and having one end protruding out of said casing for handling conveniently.

2. The device for controlling air filling and air-exhausting of an air cushion as claimed in claim 1, wherein said interactive rod has one end protruding out of said casing and pivotally provided with a sliding block.

* * * * *